United States Patent [19]

Pradel

[11] Patent Number: 4,998,643

[45] Date of Patent: Mar. 12, 1991

[54] COMPOSITE WINE AGING CONTAINER

[76] Inventor: Bernard J. Pradel, 2100 Hoffman La., Napa, Calif. 94558

[21] Appl. No.: 520,560

[22] Filed: May 8, 1990

[51] Int. Cl.[5] ..... B65D 45/32

[52] U.S. Cl. ..... 220/600; 220/320

[58] Field of Search ..... 220/66, 67, 319, 320, 220/321, 600, 320

[56] References Cited

U.S. PATENT DOCUMENTS

| | | | |
|---|---|---|---|
| 2,112,439 | 3/1938 | Graff et al. | 220/67 |
| 2,529,138 | 11/1950 | Chesney | 220/67 X |
| 4,646,931 | 3/1987 | Andrews et al. | 220/320 |
| 4,674,650 | 6/1987 | Hamilton et al. | 220/320 X |

*Primary Examiner*—Steven M. Pollard
*Attorney, Agent, or Firm*—Richard C. Litman

[57] ABSTRACT

A composite wine container for aging quality wines which comprises a cylindrical metal drum with a depending annular flange at both ends thereof to receive a gasket. Two circular wood end covers are placed at each end of the metal drum to effect closure of the wine container and to impart suitable amounts of tannin flavor to the wine. Two locking rings with adjustable mechanisms are disposed about the outer periphery of each wood end cover and each annular flange, whereby the gasket is compressed therebetween to effect a fluid-tight releasable seal.

3 Claims, 2 Drawing Sheets

COMPOSITE WINE AGING CONTAINER

BACKGROUND OF THE INVENTION

1. Field of the Invention

This invention relates generally to a durable storage container used for aging wine. More particularly, this invention relates to a composite wine container constructed of a metal drum with wood end covers in which the aging of wine is controllable and efficient.

2. Description of the Prior Art

Most quality wines are aged in oak barrels, in which the desirable sensory characteristics of the wine such as bouquet, color and flavor are largely obtained from the oxidation and extraction reactions that occur during the aging of the wine. To achieve reproducible results using traditional wine barrels, it is essential to control the parameters of the oxidation and extraction reactions that take place during the aging period. Unwanted oxidation is detrimental to the quality of wine and it is well known to minimize the rate of such oxidation during the production and aging of quality wines by protecting such wines against excessive exposure to air. However, because of the penetration of air into the wood by diffusion and the periodic loss of wine volume due to seepage, sampling and the like, all previous efforts to control the rate of oxidation in permeable wooden containers have proven to be commercially inefficient and costly.

Mostly expensive red wines and certain white wines of greater quality are required to be aged slowly, generally over a period of one to two years, depending upon the acceptable amounts of a tannin flavor which is imparted by the wood phenolics to the specified wine. However, with continuous use of wooden wine barrels over extended periods, the inner surfaces become contaminated with wine residue and the much sought after wood flavor becomes less and less available. Moreover, oak wine barrels, which are reused three to six times each, impart varying sensory characteristics to the wine according to the age of the barrel, making reproducibility from batch to batch difficult. In any event, oak barrels usually lose their flavor after about five years and most wineries discard these barrels shortly after this period of use. Also, conventional wine barrels when not in use are subject to attack by certain types of bacteria or fungi and frequently must be treated with suitable chemicals to avoid any serious contamination. Although this chemical treatment increses the life of the wood barrels, it is a time-consuming and tedious operation and may even degrade the taste of the wine if any residual chemicals are not thoroughtly removed. Accordingly, it sometimes becomes necessary to discard not only used barrels, but contaminated wooden wine barrels as well. However, in a large winery where there are a costly number of barrels made by conventional cooperage methods, the replacement cost involved becomes economically prohibitive.

Various types of wine aging containers made essentially from nonporous plastic materials or glass are found on the market today. However, these impervious containers are particularly adapted for use in home wine-making kits and are not suitable for the production of quality wines in large quantities. Moreover, the preferable flavor imparted by wooden containers is loss in these usually disposable containers and the reproducibility of other sensory properties of the wine is almost impossible to achieve.

A particular type of wine cask suitable for containing wine which is required to be aged in wood is described in U.S. Pat. No. 4,813,565 to Croser (issued Mar. 21, 1989). This patent discloses a wine cask having a circular metal base and a circular metal cover, and a plurality of wood staves extending in an axial direction therebetween. Clamp bands retain the staves in a circumferential configuration and tension clamp bands extending longitudinally along the exterior of the wine cask place the staves under compression and retain the metal base and end covers in position. Since only the base and end covers are made from relatively inexpensive metal, the overall cost of the patented wine container is not substantially reduced due to the excessive usage of the wood staves. Moreover, it is apparent that the clamp bands must be continuously adjusted to accommodate the normal contraction and expansion of the staves. Failure to make such time consuming adjustments could cause leaks which may result in harmful oxidation and spoilage of the wine batch. Thus, the Croser wine cask fails to eliminate the aforementioned disadvantages inherent in substantially wooden wine containers.

SUMMARY OF THE INVENTION

It is therefore a primary object of the present invention to provide a durable wine container for the aging of wine in which the desirable sensory properties of quality wines can be controlled and reproduced.

A further object of the invention is to provide a sealable wine aging container which does not allow the entry of contaminants, such as bacteria or excessive moisture, over extended periods of use.

It is among the additional objects of the invention to provide a wine storage container which is manufactured from inexpensive components, convenient to use, easy to assemble and disassemble, economical to maintain and may be practically designed according to the properties required in the aged wine.

Accordingly, the present invention provides a composite wine aging container comprising a metal drum having circular wood end covers. The metal drum having two full open heads at both ends thereof includes an annular flange at each end which receives a gasket and a wood cover to effect closure of the drum. A locking ring having a adjustable mechanism engages the outer periphery of the cover and the flange to provide a fluid-tight releasable seal. The sealed container of the present invention prevents unwanted oxidation which is harmful to the color, taste, composition and quality of the wine.

An important feature of the composite wine container of the present invention is that it is essentially constructed of relatively inexpensive light gauge metal to substantially reduce cost and protect the diminishing supply of available timber. Also, the wood end covers of the present containers are sufficient to impart controlled amounts of flavor to the wine at a predictable rate of oxidation.

The above description, as well as additional objects, features and aspects of the present invention, will be more fully appreciated by reference to the following detailed description, including the accompanying drawings.

DETAILED DESCRIPTION OF THE PREFERRED EMBODIMENT

Figure 1:
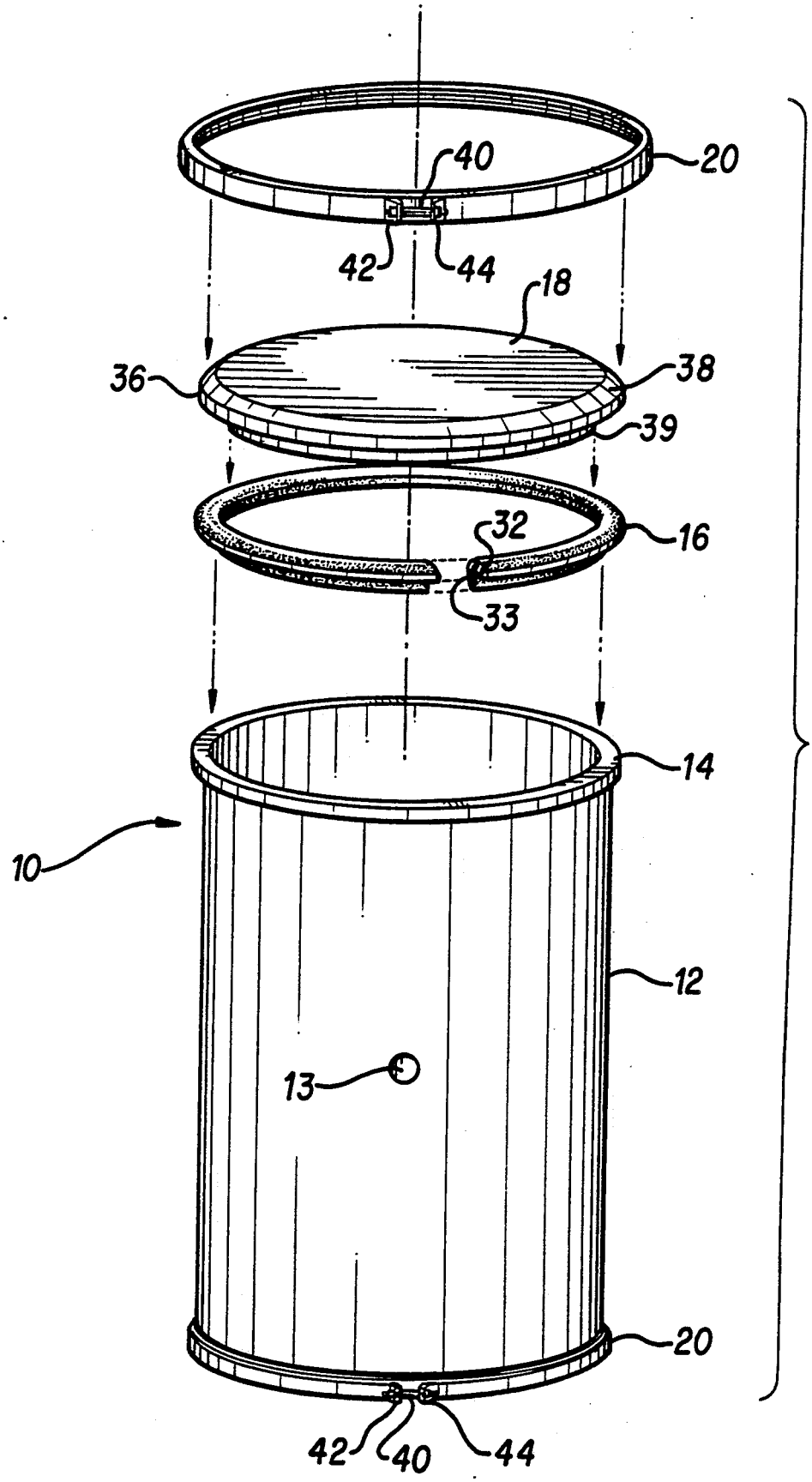
FIG. 1 is a perspective view of a composite wine container according to the present invention, illustrating an exploded view of one open end thereof with the other end assembled.

Referring now to the drawings with more particularity, the composite wine container of the present invention indicated generally as 10 in FIG. 1 is shown to comprise a full open two-head metal drum 12 with two annular flanges 14 at both ends thereof (assembled end not shown) to recieve gaskets 16 (assembled end not shown) and circular wood end covers 18 (assembled end not shown) and two locking rings 20, each having an adjustable mechanism. While container 10 is shown in an upright position, it is normally positioned on its side when aging wine.

The metal drum 12 can be formed of light gauge metal, such as 316 grade stainless steel, and may be of the same size as that of a standardized wine industry oak barrel of approximately 205 liter capacity. Preferably, the drum 12 has a cylindrical configuration with an annular rim or flange 14 which protrudes outward from the cylindrical drum at both open ends thereof. A central refill opening 13 in the side of the drum 12 is also provided which may receive a bung type stopper or cap (not shown) to enable periodic addition of wine to compensate for the loss of wine volume due to contraction, sampling and the like that occurs during the aging process. The stopper or cap (not shown) is adapted to be inserted into the refill opening 13 to provide a releasable seal for also sampling of the aging wine and permitting release of oxidation gases.

Figure 2:
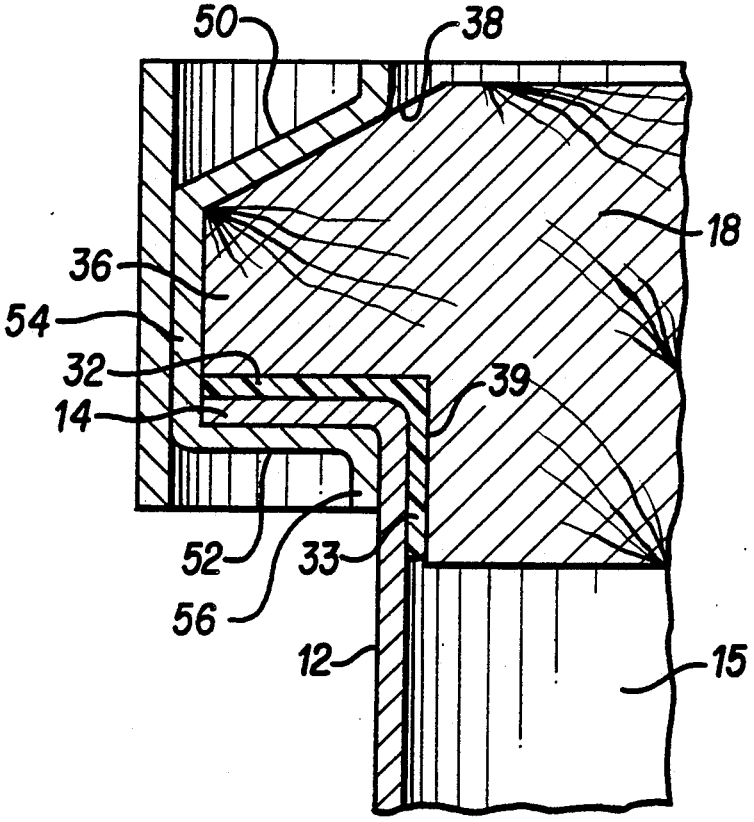
FIG. 2 is a sectional detail view of a drum closure used in the composite wine container shown in FIG. 1.

The gasket 16 illustrated in FIGS 1 and 2 is disposed between the annular flange 14 and the interior edge of the wood end cover 18. Preferably, gasket 16 is of a generally L-shaped configuration in cross section consisting of an annulus portion 32 and a depending skirt 33. The annulus portion 32 of gasket 16 is dimensioned to substantially correspond to the width and circumference of flange 14. The depending skirt 33 extends at a substantial right-angle from annulus 32 for peripherally engaging the inside wall surface of drum 12 along a limited extent therof. The annulus 32 and the depending skirt 33 each may have substantially uniform thickness to effect a seal area as will be described in greater detail hereinafter. Alternatively, the gasket 16 may consist solely of annulus 32 to form a continuous ring gasket terminating on the flange 14 to effect a fluid-tight seal.

The gasket 16 may be made of resilient, stretchable material that is not subject to attack by solvents, such as polyurethane or silicone elastomers. A suitable elastomer is a silicone rubber formulation approved by the FDA for use in wine production, such as methylvinylpolysiloxane. The suitable elastomers should be stable over a wide temperature range, resistant to oxidation and readily molded to form a continuous ring.

As best shown in the cross sectional view of FIG. 2, each circular wood end cover 18 is of solid construction having exterior and interior surface with a lip or shoulder portion 36 and a hub section 39 disposed between the interior and exterior surfaces. The interior surfaces of end cover 18 defining shoulder portion 36 and hub section 39 are shaped complementary to each open end of drum 12 and in combination with the gasket 16 provides a closing engagement therewith. The end covers 18 is preferably made of oak so that their inner surfaces are continuously exposed to wine 15 contained therein to impart the desired flavor to quality wines. To prevent the covers 18 from drying out in spots by losing contact with the wine 15, it is common practice to periodically add more wine to "top up" the container during the aging of the wine. In addition, while the amount of tannin flavor imparted to the wine aged in the composite containers of the present invention will be comparatively less than in traditional oak barrels, the parameters of the oxidation reaction occurring during the aging of the wine are more controllable. The oxidation reaction parameters are known to be determined as a function of the wood surface:volume relationship of wine containers. Since the size and characteristics of the wood end covers 18 can be maintained relatively constant, reproducibility from batch to batch may be more readily achieved. To reduce the time required for wine aging and accelerate the oxidation reaction times, a preassembled wood insert of any appropriate size and configuration apparent to those skilled in the art may be employed with the container of the present invention. A typical example of such a wood insert for increasing the interior surface area of a wine container is described in U.S. Pat. No. 4,558,639.

The lip or shoulder 36 of each cover 18 extends over the top of the gasket 16 which is disposed on each flange 14 of the drum 12. The cover hub 39 is received in each end opening of the drum 12 and engages the depending skirt 33 of gasket 16. A locking ring 20 is also provided having an adjustable mechanism comprising a bolt 40 passing through lateral projections 42 and 44 for taking up the locking ring 20 and compressing upon the cover 18. The lateral projections 42 and 44 may be suitably affixed to the locking ring 20 by welding or the like. Preferably, the locking ring 20 has a slanted upper interior edge 50 and a lower interior lip 52 with a depending annular flange 56 which extends downward from the lower locking ring lip 52. An annular band 54 generally perpendicular to flange 14 joins the converging upper edge 50 and the lower lip 52. The slanted upper interior edge 50 engages a complementary inclined exterior edge 38 of cover 18 and the lower locking ring lip 52 engages the drum flange 14. The depending annular flange 56 engages the outer wall surface of the drum to effect an annular sealed area.

When the bolt 40 is tighten to take up the locking ring 20, the upper locking ring edge 50 engages the outer periphery of the cover shoulder 36 and the lower locking ring lip 52 engages the underside of the flange 14, whereby the gasket annulus 32 is compressed therebetween to effect a seal between the cover shoulder 36 and the flange 14. Simultaneously, the depending annular flange 56 of lower locking ring lip 52 engages the outer wall surface of the drum 12 to press the latter against cover hub 39, whereby the depending skirt 33 of gasket 16 is compressed therebetween to effect a seal between the cover hub 39 and the inner wall surface of the drum 12. Accordingly, an effective double seal if formed, precluding any possibility of fluid flow inwardly into the drum or outwardly therefrom. Also, it should be understood that various types of adjustment means on the locking ring may be employed with the containers of the present invention. Lever-bolt locking rings, for example, are likewise applicable for sealing containers in accordance with the present invention.

The wine aging container of the present invention may be easily assembled and disassembled so that the wood end covers can be readily removed, so as to expose fresh oak to the wine in order to continue to impart the desired flavor to the wine and allow more rapid aging of the wine. In addition to allowing the winemaker to predict and control the development of the wine aging process by protecting the wine against excessive exposure to air and moisture, the composite container of the invention is relatively inexpensive and readily produced, resulting in a significant economy in time and cost of manufacture of the wine.

It should be understood that there may be various changes and modifications of the embodiments herein chosen for purposes of disclosure without departing from the spirit and scope of the invention. Accordingly, the foregoing description is not to be interpreted as restrictive of the invention beyond that necessitated by the following claims.

I claim:

1. A composite container for aging wine which is required to be aged in wood comprising:

a cylindrical metal drum having two full open heads at both ends thereof, including an annular flange protruding outward from the metal drum at each end and a central refill opening in a side of said cylindrical metal drum for periodic addition of wine thereto;

two circular oak end covers of solid construction for closure of the cylindrical metal drum and to impart controllable amounts of tannin flavor to the wine, each circular oak end cover having interior and exterior surfaces with a shoulder portion and a hub section disposed between the interior and exterior surfaces, said interior surfaces of the end cover being shaped complementary to each of said open heads at each end of the metal drum;

two ring gaskets, each disposed in sealing engagement between said annular flange and each of said circular oak end covers;

two locking rings having an adjustable mechanisms secured thereto, each locking ring being disposed on the outer periphery of each circular oak end cover and said annular flange to effect a fluid-tight releasable seal.

2. The composite container of claim 1 wherein each of said ring gaskets is of a generally L-shaped configuration.

3. The composite container of claim 1 wherein each of said ring gaskets is made of polyurethane or silicone elastomers.

* * * * *